US009362021B2

(12) United States Patent
Winterhalter et al.

(10) Patent No.: US 9,362,021 B2
(45) Date of Patent: Jun. 7, 2016

(54) COMPOSITE CORE CONDUCTORS AND METHOD OF MAKING THE SAME

(75) Inventors: Michael Winterhalter, Dana Point, CA (US); Terry McQuarrie, Gardnerville, NV (US)

(73) Assignee: GIFT TECHNOLOGIES, LLC, Harbor City, CA (US)

( * ) Notice: Subject to any disclaimer, the term of this patent is extended or adjusted under 35 U.S.C. 154(b) by 484 days.

(21) Appl. No.: 13/227,353

(22) Filed: Sep. 7, 2011

(65) Prior Publication Data

US 2012/0186851 A1 Jul. 26, 2012

Related U.S. Application Data

(60) Provisional application No. 61/435,725, filed on Jan. 24, 2011, provisional application No. 61/450,525, filed on Mar. 8, 2011.

(51) Int. Cl.
*H01B 5/10* (2006.01)

(52) U.S. Cl.
CPC ..... *H01B 5/105* (2013.01)

(58) Field of Classification Search
CPC ..... H01B 5/102; H01B 5/107
USPC ..... 174/102 R, 104, 105 SC, 106 R, 106 SC, 174/109, 110 SC, 110 P, 110 R, 112, 116, 174/120 R, 120 SR, 121 R, 122 R, 124 R; 57/145–146; 29/825; 428/611–614
See application file for complete search history.

(56) References Cited

U.S. PATENT DOCUMENTS

| | | | | | |
|---|---|---|---|---|---|
| 1,489,402 | A | * | 4/1924 | Varney | 174/131 R |
| 2,075,996 | A | * | 4/1937 | Noyes | 174/105 R |
| 2,320,313 | A | * | 5/1943 | Thomas et al. | 178/45 |
| 2,589,507 | A | * | 3/1952 | Noyes | 174/127 |
| 2,892,880 | A | * | 6/1959 | Hohn | 174/8 |
| 2,924,141 | A | * | 2/1960 | Kinniburgh | 87/9 |
| 3,126,442 | A | * | 3/1964 | Roberts | 174/69 |
| 3,324,233 | A | | 6/1967 | Bryant | |
| 3,576,705 | A | | 4/1971 | Goldsworthy | |
| 3,579,402 | A | | 5/1971 | Goldsworthy et al. | |
| 3,650,864 | A | | 3/1972 | Goldsworthy | |
| 3,717,720 | A | * | 2/1973 | Snellman | 174/131 A |
| 3,769,127 | A | | 10/1973 | Goldsworthy et al. | |
| 3,842,584 | A | * | 10/1974 | Schmittman | 57/216 |

(Continued)

FOREIGN PATENT DOCUMENTS

| | | |
|---|---|---|
| CN | 201536017 U | 7/2010 |
| CN | 101814338 A | 8/2010 |

(Continued)

OTHER PUBLICATIONS

Machine English translation with Certification of Translation of Japanese Published Utility Model Application No. 6-7112, published Jan. 28, 1994; (7 pages).
Office Action on Ex Parte Reexamination dated Jul. 13, 2011, for U.S. Appl. No. 90/011,652, filed Apr. 20, 2011; 26 Pages.

(Continued)

*Primary Examiner* — William H Mayo, III
(74) *Attorney, Agent, or Firm* — Lewis Roca Rothgerber Christie LLP

(57) ABSTRACT

Electrical cables for the transmission of electricity between power poles or towers with at least one of a cooling feature and a fail safe feature and methods of producing the same.

44 Claims, 7 Drawing Sheets

(56) References Cited

U.S. PATENT DOCUMENTS

| | | | | |
|---|---|---|---|---|
| 4,422,718 | A | 12/1983 | Nakagome et al. | |
| 4,441,787 | A | 4/1984 | Lichtenberger | |
| 4,449,012 | A | 5/1984 | Voser | |
| RE32,374 | E | 3/1987 | Dey et al. | |
| 4,690,497 | A | 9/1987 | Occhini et al. | |
| 4,770,489 | A | 9/1988 | Saito et al. | |
| 4,793,685 | A | 12/1988 | Taylor et al. | |
| 4,966,434 | A | 10/1990 | Yonechi et al. | |
| 5,043,538 | A * | 8/1991 | Hughey et al. | 174/107 |
| 5,082,379 | A | 1/1992 | Lindner et al. | |
| 5,114,290 | A * | 5/1992 | Moghe | 411/411 |
| 5,200,261 | A | 4/1993 | Taguchi et al. | |
| 5,222,173 | A | 6/1993 | Bausch | |
| 5,285,613 | A | 2/1994 | Goldsworthy et al. | |
| 5,297,654 | A | 3/1994 | De Forges De Parny et al. | |
| 5,304,739 | A * | 4/1994 | Klug et al. | 174/102 R |
| 5,360,497 | A | 11/1994 | Schneider et al. | |
| 5,495,546 | A * | 2/1996 | Bottoms et al. | 385/101 |
| 5,808,239 | A | 9/1998 | Olsson | |
| 6,245,425 | B1 * | 6/2001 | McCullough et al. | 428/379 |
| 6,496,628 | B1 * | 12/2002 | Opel et al. | 385/110 |
| 2002/0132905 | A1 * | 9/2002 | Babinee et al. | 524/495 |
| 2003/0124377 | A1 * | 7/2003 | McCullough et al. | 428/611 |
| 2004/0185290 | A1 * | 9/2004 | McCullough et al. | 428/614 |
| 2008/0172873 | A1 * | 7/2008 | Goldsworthy et al. | 29/857 |
| 2008/0233380 | A1 * | 9/2008 | Hiel et al. | 428/299.4 |
| 2010/0293783 | A1 * | 11/2010 | Goldsworthy et al. | 29/825 |

FOREIGN PATENT DOCUMENTS

| | | | |
|---|---|---|---|
| CN | 201590283 | U | 9/2010 |
| FR | 2 941 812 | A1 | 8/2010 |
| JP | 05-154919 | | 6/1993 |
| JP | 10-321048 | | 12/1998 |
| WO | WO 2010/089500 | A1 | 8/2010 |

OTHER PUBLICATIONS

Invitation to Pay Additional Fees and, Where Applicable, Protest Fee, dated Nov. 28, 2011, for International Application No. PCT/US2011/050714, Filed Sep. 7, 2011; 6 Pages.

International Search Report and the Written Opinion of the International Search Authority, dated Jan. 26, 2012, for International Application No. PCT/US2011/050714, Filed Sep. 7, 2011; 16 Pages.

American Society of Civil Engineers; Structural Plastics Selection Manual (ASCE Manuals and Reports on Engineering Practice No. 66); New York, New York; 1985; 27 Pages.

Gambone, L.R.; Alternative Materials for Overhead Conductors (Report); Powertech Labs Inc.; Surrey, B.C.; Dec. 1991; 79 Pages.

Kumar, Sujit S.; Characterization of Dynamic Mechanical Properties of Pultruded Hybrid Cylindrical Composite Rods in the Torsional and Flexural Modes of Vibration (Thesis); The University of Mississippi; May 1994; 87 Pages.

Newas, G. et al.; Structural Composite Cores for Overhead Power Transmission Conductors (Research Product-Final Report); Battelle Columbus Division; Columbus, Ohio; Apr. 1987; 50 Pages.

Papineni, Kumar N.V.S.; Study of Static Mechanical Properties of Pultruded Hybrid Graphite/Glass-Epoxy Composites (Thesis); The University of Mississippi; Dec. 1994; 114 Pages.

Reinhart, Theodore J. et al; Composites (Engineered Materials Handbook); vol. 1; ASM International; Metals Park, Ohio; Nov. 1987; 11 Pages.

Vaughan, James G. et al.; Characterization of Mechanical and Thermal Properties of Advanced Composite Pultrusions (Electric Power Research Institute—Research Project-Final Report); The University of Mississippi; Aug. 1995; 214 Pages.

State Intellectual Property Office of P.R. China; Notice of the First Office Action mailed Dec. 30, 2013, for Application No. 201210017032.3; 14 Pages.

SIPO Notice of Second Office Action dated Aug. 28, 2014 for Application No. 201210017032.3; 10 pages.

* cited by examiner 22
20
20
20
20
20
20
20
14

14
23
21

14
23
27

COMPOSITE CORE CONDUCTORS AND METHOD OF MAKING THE SAME

CROSS-REFERENCE TO RELATED APPLICATIONS

This application claims the benefit of and priority to U.S. Provisional Patent Application No. 61/435,725, filed on Jan. 24, 2011, and on U.S. Provisional Patent Application No. 61/450,525, filed on Mar. 8, 2011, the contents of both of which are hereby fully incorporated herein by reference.

BACKGROUND OF THE INVENTION

Composite core conductor cables have a composite core supporting a conductor. Such cables have many advantages. However, when there is a failure of the conductor due to core failure, for example when the cable splits in two, the split cable ends may fall to the ground and initiate a hazardous condition. Similarly, when exposed to high heat, the cores of such cables tend to expand and sag and may come in contact with objects on the ground, creating a hazardous situation. Additionally, the operation of conductors at elevated temperature is inefficient in that their current carrying capacity is reduced. Thus, composite core conductors that address these issues are desired.

SUMMARY OF THE INVENTION

In an exemplary embodiment an electrical cable for the transmission of electricity between power poles or towers is provided. The cable includes a core formed from a fiber reinforced composite material reinforced by at least a first fiber, a thermally conductive veil or cladding surrounding the core, and a conductor surrounding the core and the first fiber. In another exemplary embodiment, the veil or cladding is pultruded over the core. In a further exemplary embodiment, the veil or cladding is made from the same material as the conductor. In yet another exemplary embodiment, the conductor includes aluminum and the veil or cladding also includes aluminum. In yet a further exemplary embodiment, the conductor includes copper and the veil or cladding also includes copper. In another exemplary embodiment, the cable also includes a second fiber over the veil or cladding. In yet another exemplary embodiment a fiber braid surrounds the core or a fiber is braided around the core.

In a further exemplary embodiment a method of forming an electrical cable for the transmission of electricity between power poles or towers is provided. The method includes pultruding a core from a fiber reinforced composite material reinforced by at least a first fiber, pultruding a thermally conductive veil or cladding over the core, and surrounding the core and veil or cladding with a conductor material. In one exemplary embodiment, the core and the veil or cladding are pultruded simultaneously or sequentially. In yet another exemplary embodiment, the method further includes placing a second fiber over the veil or cladding. In yet a further exemplary embodiment, the method also includes surrounding the veil or cladding with a fiber braid.

In another exemplary embodiment, a method of forming an electrical cable for the transmission of electricity between power poles or towers is provided. The method includes pultruding a core from fibers and a resin, applying a thermally conductive particulate material to an outer surface of the core during the pultruding, and surrounding the core with a conductor material. In one exemplary embodiment, applying a thermally conductive particulate material includes mixing the particulate material with the resin forming the outer surface of the core.

In another exemplary embodiment, an electrical cable for the transmission of electricity between power poles or towers is provided and includes a core having a length and formed from a fiber reinforced composite material and having a groove formed on its outer surface, a conduit within the groove, the conduit carrying a cryogenic material, and a conductor surrounding the core and the conduit. In one exemplary embodiment, the cryogenic material is a cryogenic fluid. In another exemplary embodiment, the cable further includes a second groove and a fiber in the second groove, where the fiber has a greater length than the core and may extend beyond one or both ends of the core.

In a further exemplary embodiment, a method of forming an electrical cable for the transmission of electricity between power poles or towers is provided. The method includes pultruding a core from fibers and a thermally conductive particulate material filled resin, and surrounding the core with a conductor material. In one exemplary embodiment, applying a conductive particulate material includes mixing the particulate material with the resin for forming the outer surface of the core. In another exemplary embodiment, the thermally conductive particulate material includes aluminum particulate material. In yet another exemplary embodiment, the thermally conductive particulate material is mixed with a resin in a ratio of 20%-50%. In yet a further exemplary embodiment, the thermally conductive particulate material is the same type as the material forming the conductor.

In another exemplary embodiment, a method of forming an electrical cable for the transmission of electricity between power poles or towers is provided. The method includes pultruding a core having an inner portion formed from fiber reinforced resin, and an outer portion surrounding at least a portion of the inner portion, the outer portion formed from a fiber reinforced resin including a thermally conductive particulate material, where both the inner and outer portions of the core are pultruded simultaneously or sequentially, and surrounding the core with a conductor material. In one exemplary embodiment, forming the outer portion includes forming an outer layer having a radial thickness of at least ½ mil. In another exemplary embodiment, the thermally conductive particulate material includes aluminum. In yet another exemplary embodiment, the thermally conductive particulate material is mixed with a resin in a ratio of 20% to 50% by weight. In yet a further exemplary embodiment, the thermally conductive particulate material is of the same type as the conductor material. In another exemplary embodiment, the type of the resin forming the inner portion is different from the type of the resin forming the outer portion. In yet another exemplary embodiment, the method also includes adding at least one of carbon nanotubes and carbon black to at least the resin forming the outer portion. In one exemplary embodiment, at least one of carbon nanotubes and carbon black is added at a ratio relative to the at least the resin forming the outer portion. In another exemplary embodiment, the ratio is not greater than 3% by weight.

In another exemplary embodiment, an electrical cable for the transmission of electricity between power poles or towers is provided including a core formed from a fiber reinforced resin material reinforced by at least a first fiber, wherein at least a portion of the resin material forming at least an outer surface of the core includes a thermally conductive particulate material. The cable also includes and a conductor surrounding the core and the second fiber. In one exemplary embodiment, an outer surface portion of the core has a material thickness of at least ½ mil is formed from the resin including the conductive particulate material, and the outer surface portion is a layer surrounding a central portion. In another exemplary embodiment, the thermally conductive particulate material includes aluminum. In a further exemplary embodiment, the thermally conductive particulate material is mixed with a resin in a ratio of 20% to 50% by weight. In yet another exemplary embodiment, the thermally conductive particulate material is of the same type as the material forming the conductor. In yet a further exemplary embodiment, an outer surface portion is a layer formed from a first resin including the conductive particulate material and a central portion is formed from a second resin different from the first resin, wherein the outer surface portion surrounds the central portion. In one exemplary embodiment, the cable also includes at least one of carbon nanotubes and carbon black to the resin mixed with the resin.

In another exemplary embodiment, an electrical cable for the transmission of electricity between power poles or towers is provided including a core formed from a fiber reinforced composite material reinforced by at least a first fiber, the core having a tensile strength, a bore within the core and extending along the length of the core, a second fiber within the bore having a length greater than the length of the core, and a conductor surrounding the core and the second fiber. In one exemplary embodiment, the second fiber is impregnated with a flexible resin system. In a further exemplary embodiment, a flexible core including the second fiber extends within the bore.

In yet another exemplary embodiment a method of forming an electrical cable for the transmission of electricity between power poles or towers is provided. The method includes pultruding a core having an inner portion formed from a fiber reinforced resin, and at least an outer portion formed from a fiber reinforced resin filled with at least one of carbon nanotubes and carbon black, and surrounding the core with a conductor material. In one exemplary embodiment, the at least one of carbon nanotubes and carbon black is added at a ratio relative to the resin of the at least an outer surface portion of no greater than 3% by weight. In another exemplary embodiment, the at least one of carbon nanotubes and carbon black is added at a ratio relative to the resin of the at least an outer surface portion of no greater than 1% by weight. In yet a further exemplary embodiment, the at least an outer surface portion is an outer surface portion surrounding an inner portion. In yet another exemplary embodiment, the inner and outer portions are formed from the same fiber reinforced resin. In another exemplary embodiment, the inner and outer portions are formed from the same fiber reinforced resin filled with at least one of carbon nanotubes and carbon black.

In yet a further exemplary embodiment, an electrical cable for the transmission of electricity between power poles or towers is provided including a core formed from a fiber reinforced composite material reinforced by at least a first fiber, where the core has a tensile strength and a length. An axially expandable netting extends along the core, the netting having a tensile strength sufficient for supporting the weight of the cable, the netting being expandable while the cable is suspended between the towers or poles, and a conductor surrounding the core. In one exemplary embodiment, the netting runs in a groove along the length of the core. In another exemplary embodiment, the netting runs in a bore in the core. In yet another exemplary embodiment, the netting does not support the weight of the cable when the cable is suspended between the towers or poles. In one exemplary embodiment, when the cable is suspended between the towers or poles, the netting is not fully expanded. In another exemplary embodiment, the netting is fixed at each tower or pole. In a further exemplary embodiment, the conductor surrounds the netting. In yet a further exemplary embodiment, the netting surrounds the core. In yet a further exemplary embodiment, the netting defines a cylinder, and the core is within the cylinder.

DETAILED DESCRIPTION

Figure 1:
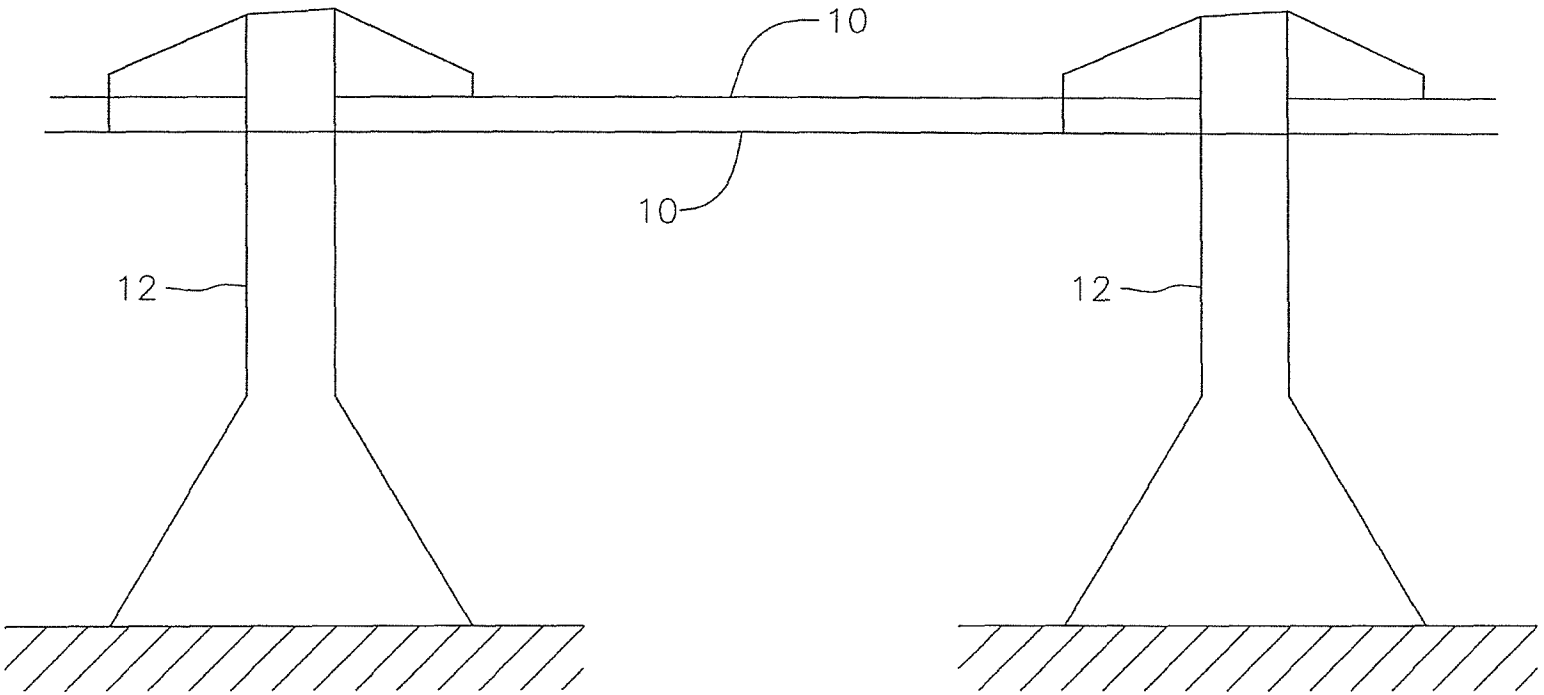
FIG. 1 is a view of two support towers supporting two exemplary embodiment composite core conductor cables of the present invention.
Figure 2:
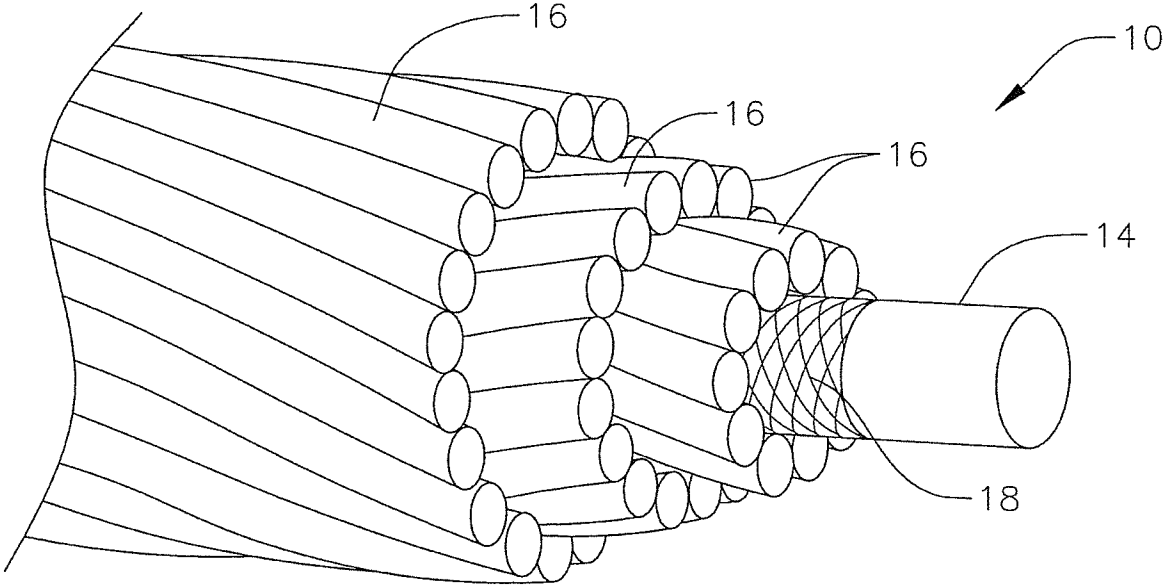
FIG. 2 is a partial perspective view of a composite core conductor cable of the present invention.

A composite core conductor cable 10 for the transmission of electricity between transmission towers 12 as for example shown in FIGS. 1 and 2, is disclosed U.S. Pat. No. 7,752,754, the entire content of which is fully incorporated herein by reference. A typical composite core conductor has a central core 14 formed from a composite material, such as a fiber reinforced plastic material, which is surrounded by at least one layer of a conductor 16, typically formed from strands of conductor material such as aluminum or copper, etc. for transmitting electricity. In an exemplary embodiment, the fiber reinforced plastic material includes a resin, as for example a thermoplastic resin such as polypropylene or polycarbonate resin or a thermosetting resin such as phenolic, epoxy, vinyl ester, polyester, or polyurethane resin, reinforced with reinforcing fibers (or fiber material) of glass, boron, carbon or the like, or any combination thereof. In an exemplary embodiment, the core is either extruded or pultruded. In a preferred exemplary embodiment, the core is pultruded. Once the core 14 is formed by pultrusion, the conductor material 16 is stranded around the core. In an exemplary embodiment, once a core is formed by pultrusion, a fail safe netting or a mesh or wrap (collectively or individually referred to herein as "netting") 18 formed from fibers or a fiber material or a braided fiber material (i.e., a fiber braid) is wrapped, slipped over or otherwise positioned over the core prior to the stranding with the conductor material. In an exemplary embodiment, the fibers are braided over the core to form the braid or they are wound over the core. The conductor material is then stranded over the netting. In other words, the netting is sandwiched between the core and the conductor material. In an exemplary embodiment, the netting is made from aramid, carbon, S-glass or any other material that is capable of holding the weight of the broken cable, i.e., the weight of the two broken sections of the cable and the defining moment as the broken sections drop towards the ground. In another exemplary embodiment, the netting may be formed from a conductive material. In another exemplary embodiment, the netting is not adhered to either the core or the conductor. This netting forms a fail safe system in that if the composite core were to fail (e.g.

break), the netting would hold the core in place such that the cable would not drop to the ground and cause hazard, such as fire and the like.

In another exemplary embodiment, instead of netting, linear fibers may run along the length of the core outer surface. In yet another exemplary embodiment, instead of the netting 18, fibers 20 different from the fibers forming the fiber reinforced composite material are placed on the outer surface 22 of the core during the pultrusion process, such that they are at least partially, if not fully, embedded in the outer surface of the core, as for example shown in FIG. 3A. In an exemplary embodiment, such fibers would have a strength greater to the lateral load applied before the break (i.e., the weight of two sections of broken conductor, plus the moment exerted prior and after to the break). In an exemplary embodiment, these fibers may include high strength glass or high strength glass fibers, or may be any other type of fiber that has a greater tensile strength than the strength of the core without such fibers.

Figures 3A, 3B, 3C:
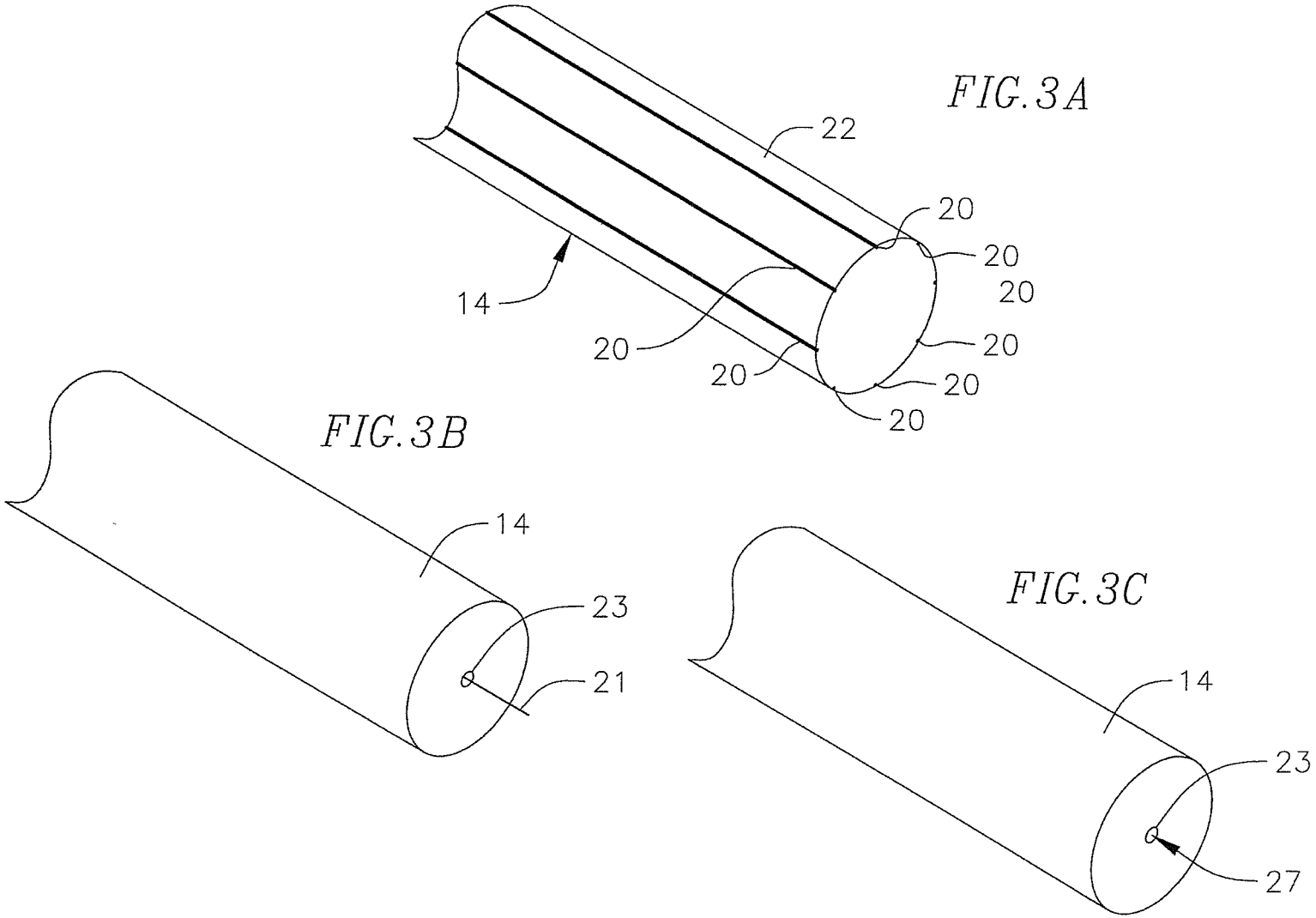
FIGS. 3A, 3B, 3C, 4 and 5 are partial perspective views of various exemplary embodiment cores used in exemplary embodiment composite core conductor cables of the present invention.

In another exemplary embodiment, shown in FIG. 3B a fail safe fiber 21 or fail safe fibers 21 having a greater tensile strength than the core may be run through the core. This may be accomplished by having a bore 23 along the length of the core and running such fiber of fibers along such length through the bore. In another exemplary embodiment, as shown in FIG. 3B the fail safe fiber or fibers 21 are impregnated with a flexible resin system 25, forming a flexible core portion 27 surrounded by the core 14. Exemplary flexible resin systems may include thermoplastics or thermoset resin systems. With this exemplary embodiment, the flexible core portion is also expandable.

Figure 4:
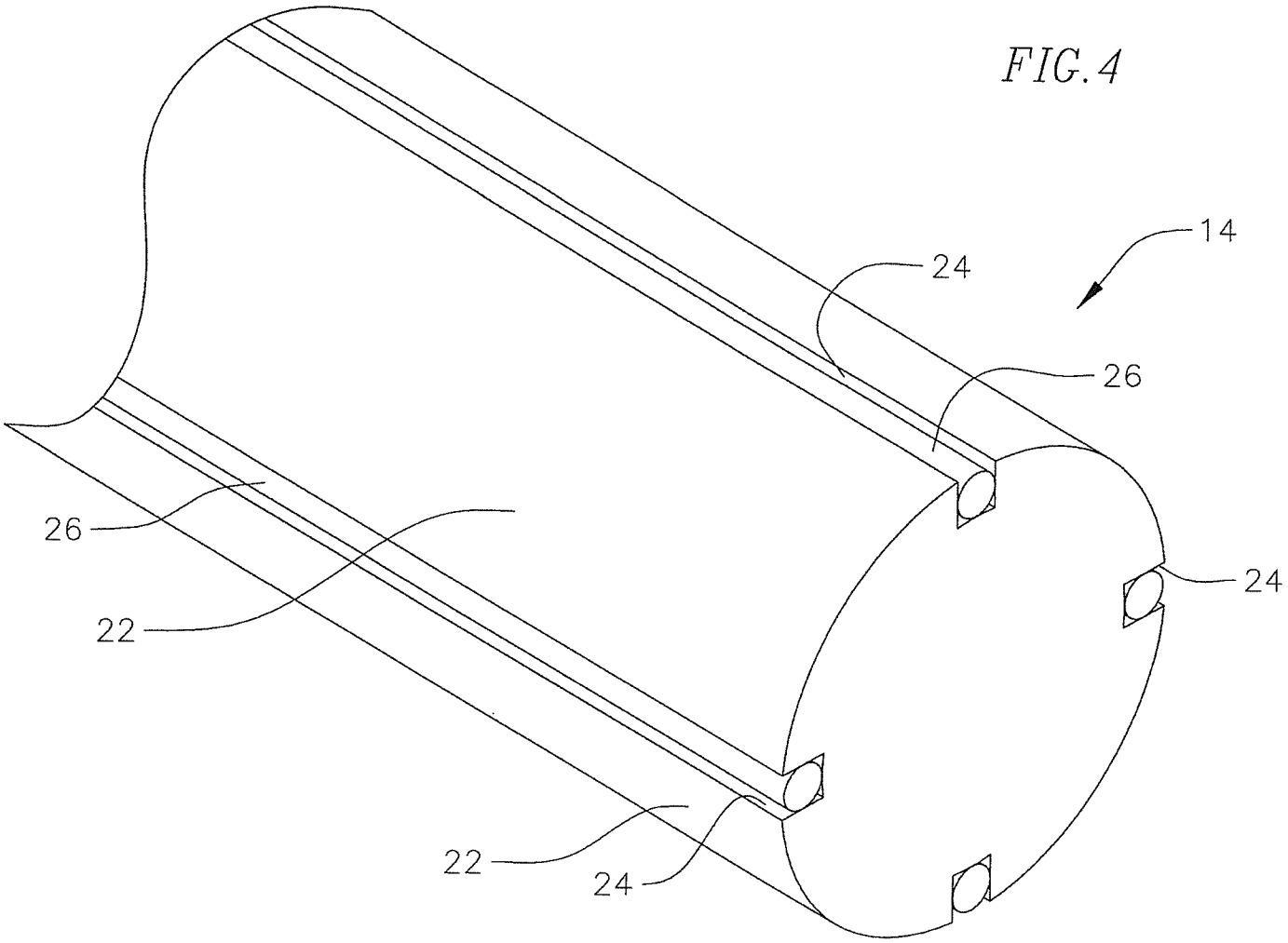
Figure 5:
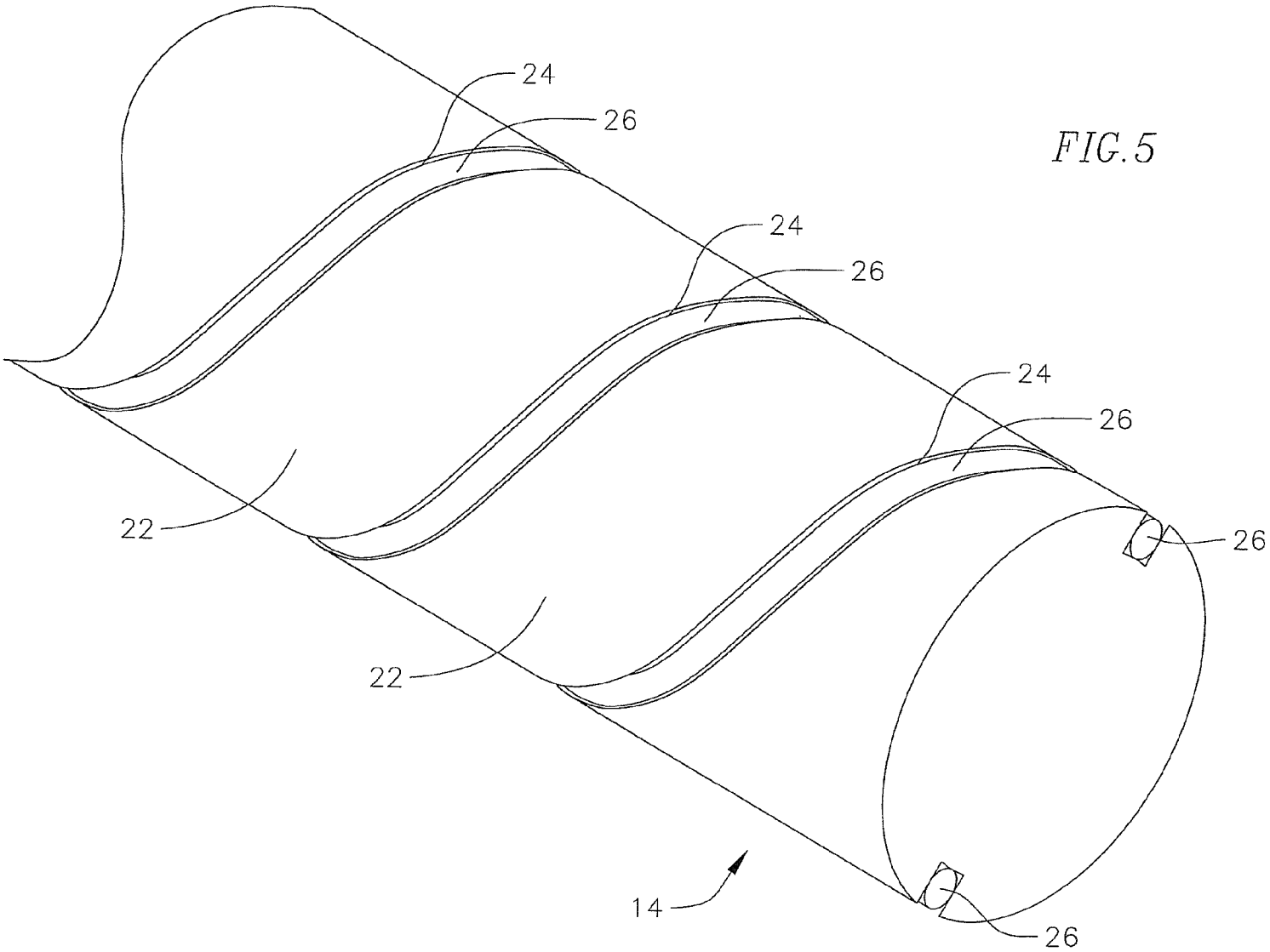

In yet another exemplary embodiment, the composite core is pultruded with grooves 24 formed on its the outer surface 22, as for example shown in FIG. 4. Although, FIG. 4 shows an embodiment with four grooves, other embodiments may have less than four or more than four grooves. In a further exemplary embodiment, the grooves 24 may be non-linear. In one exemplary embodiment, as shown in FIG. 5, one or more helical grooves 24 wind around the outer surface 22 of the core 14. In another exemplary embodiment linear fibers 26 or a netting are placed in the grooves 14 to provide a fail safe feature.

Figures 8A, 8B:
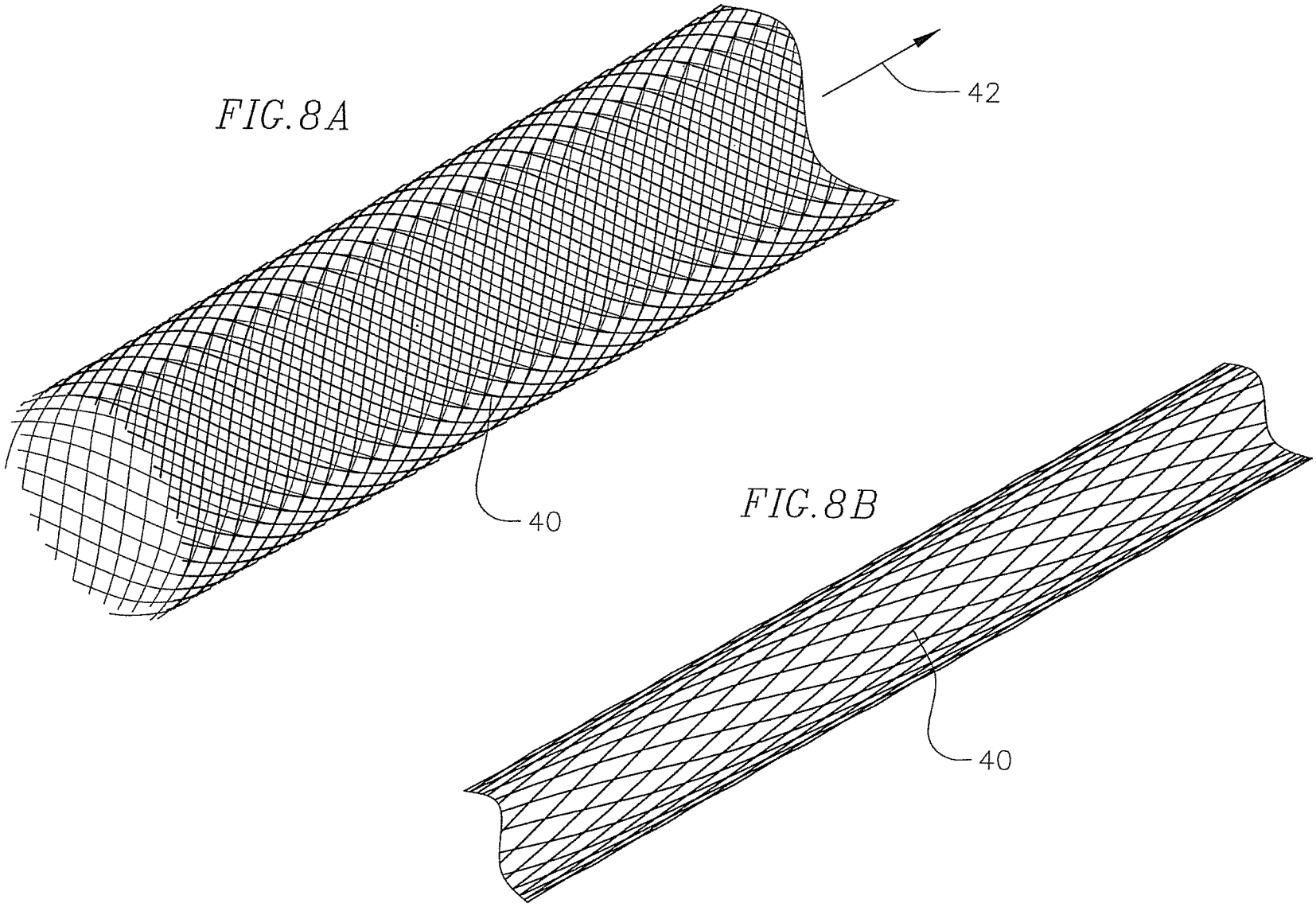
FIGS. 8A and 8B are partial plan views of a fail safe netting of the present invention in its normal state and in its expanded state, respectively.

In another exemplary embodiment a fail safe feature is formed by having a single or a plurality of fibers that run within the core, as for example within a bore or groove and/or externally of the core, and/or within a bore extending through the core but which have a greater length than the core so as to not absorb any loads while the cable is suspended between towers or poles. In other words, the fail safe fiber(s) have sufficient length such that when the cable is suspended between towers or poles, and the fail safe fiber(s) are fixed at each tower/pole, they do not support any of the cable weight. If the cable breaks, the fail safe fiber(s) will retain the broken cable and keep it from falling to the ground and causing a hazard. As such, in an exemplary embodiment, these fibers should have a tensile strength that is sufficient to hold the weight of the cable in case of cable breakage as well as the impact of the weight as the broken cable attempts to fall to the ground. In another exemplary embodiment, fail safe fibers may be interwoven to form an expandable fail safe netting 40 defining a cylinder, as for example shown in FIG. 8A. When pulled (i.e., when under an axial load 42) the netting 40 will expand in length while reducing in diameter, as for example shown in FIG. 8B. In this regard, the netting will not absorb any loads when in a non-expanded state. With this embodiment, when the cable is suspended between towers, the fail safe netting is fixed to each tower/pole in a non-expanded state or a state where it is not fully expanded. If the cable breaks, the two broken cable ends begin to fall to the ground engaging the netting, causing it to expand and neck down, absorbing the weight as well as the impact of the broken cable, and preventing it from falling to the ground. Moreover, as the netting tightens, it may frictionally engage and clamp on the broken core sections together. Thus, the netting should have a sufficient tensile strength to support the weight of the cable, as well as the impact of the weight of the failed cable section as this attempt to fall to the ground.

The fail safe netting or the fail safe fibers may be fixed at the towers or poles from which the cables are suspended or they may be fixed to the cable itself, preferably proximate the opposite ends of the cable.

The problem with conductor cables used in the transmission of electricity between transmission towers is that they heat up. The more electricity that is carried by the conductor, the more heat generated by the conductor. When a cable heats up, the conductor material becomes less conductive. In addition, an increase in heat causes an increase in sag of the cable between the towers. Sag is undesirable for obvious reasons. For example, if adjacent cables sag too much, they may end up hitting each other when exposed to wind or movement or they may hit trees or other obstacles over which they are suspended.

In a stranded conductor with a non-conductive composite core, such as the composite core 14, heat is transferred to the core by the adjacent conductor strands 16 by conduction (with perhaps minor convection by heated air in the conductor interstices). The heat is generated non-uniformly by the flow of electrical current due to the conductor strand resistance. The amount of heat transferred to the core is a function of the ability of the conductor to dissipate heat to the atmosphere through convection, radiation, and reflection. This convection, radiation and reflection determines the radial temperature gradient from the core surface to the conductor outer surface. It is recognized that the core surface temperature will normally be higher than the outer conductor surface.

Current flowing through the metallic conductor results in the generation of heat due to the current flow through the conductor resistance. The resultant heating, creates a power (watts) loss which is a function of the conductor resistance and current magnitude, according to the formula, $W=I^2R$ in which I=current and R is the conductor resistance (which is also dependent upon temperature). Additional factors that affect the conductor temperature include solar radiation, emissivity, absortivity, wind, etc.

As discussed, heat transfer from the conductor is primarily by convection, radiation and reflection from the outer surface. Thus, the hottest part of the conductor is the innermost stranded layer and a radial thermal gradient exists between the inner and outer layers. Although the primary mechanism of heat transfer and cooling is radial, there is also some axial cooling and heat transfer.

Figure 6:
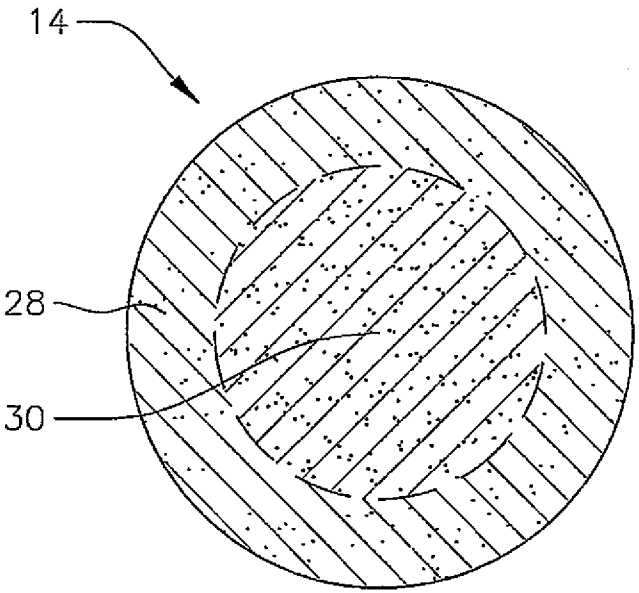

To deal with the detrimental affects of heating, in another exemplary embodiment, a thermally conductive particulate material such as, for example, aluminum powder and/or aluminum flakes is/are mixed with the resin forming the composite core 14 and such resin is used to form the core by pultruding it with the desired reinforcing fibers. For convenience, the particulate material, whether powder, flakes or otherwise, is referred to herein as "filler". Moreover, the present invention is described with using aluminum filler by way of example. Other thermally conductive fillers may also be used. In another exemplary embodiment, the resin mixed with the thermally conductive filler is used to form an outer layer (or portion) 28 of the core 14 surrounding an inner portion 30 of the core, as for example shown in FIG. 6. In other words, the inner portion 30 of the core is formed with a resin without the aluminum filler whereas the outer portion 28 of the core is formed with a resin including the aluminum filler. In an exemplary embodiment, both inner and outer core portions are simultaneously or sequentially pultruded to form one solid core. In one exemplary embodiment, an aluminum filler filled thermoset resin is used to form the entire core. In another exemplary embodiment, an aluminum filler filled thermoset resin is used to form an outer surface portion or layer of the core. An exemplary aluminum filler filled urethane coating is made by ProLink Materials. The aluminum filler used is designated as AL-100 and is manufactured by Atlantic Equipment Engineer. The ratio of aluminum filler to resin in an exemplary embodiment is in the range of 20% to 50% by weight. In one exemplary embodiment, the ratio is 20%. In another exemplary embodiment, the ratio is 30%. In yet another exemplary embodiment, the ratio is 40%. In yet a further exemplary embodiment, the ratio is 50%. In the exemplary embodiment where the aluminum filled resin is used to form only an outer surface layer 28 of the composite core which is pultruded, simultaneously or sequentially, with the inner core portion which does not include the aluminum filler, the outer layer 28 has a thickness of about 1 and ½ mil. In another exemplary embodiment, the outer layer 28 including the aluminum filler may have a thickness that is in the range of ½ mil to 50% of the radius of the entire core. In another exemplary embodiment the resin filled with aluminum filler used to form the outer layer 28 may be different from the resin forming the inner portion 30 of the core. Different resin combinations include, but are not limited to, polyester, vinyl ester, epoxy, phenolic, thermoplastics like polypropylene, and polycarbonates. Aluminum filler is the preferred thermally conductive filler if the conductor 16 is made of aluminum so as to prevent any dissimilar metal corrosion when the conductor is proximate or in contact with the conductive powder filled resin core surface. If the conductor 16 is made of another material, as for example copper, than a similar filler, as for example a copper filler should be mixed with the appropriate resin.

In another exemplary embodiment, instead of conductive particulates, i.e., filler, carbon nanotubes and/or carbon black may be mixed with the resin for forming the entire core or for forming an outer layer of the core. In another exemplary embodiment the carbon nanotubes and/or the carbon black may be added to the resin as described above in relation to the thermally conductive filler. The nanotubes and/or the carbon black may be added in lieu of, or in addition to, the thermally conductive filler. Applicants believe that the addition of the carbon nanotubes and/or carbon black to the resin will convert the core or portion of the core formed by the resin mixed with the carbon nanotubes and/or the carbon black into a heat conductor. It is also believed the carbon nanotubes will impact strength. It is believed that the carbon nanotubes and/or the carbon black added should be no greater than 3% by weight of the overall resin mixture with the conductive filler (if used) and the carbon nanotubes and the carbon black. Preferably, however, the carbon nanotubes and/or the carbon black should be no greater than 1% by weight. Exemplary nanotubes could have a diameter in the range of 0.5 nm to 2 nm, a tensile strength in the range of 13 GPa to 126 GPa and an elongation at breakage in the range of 15% to 74%.

Figure 7:
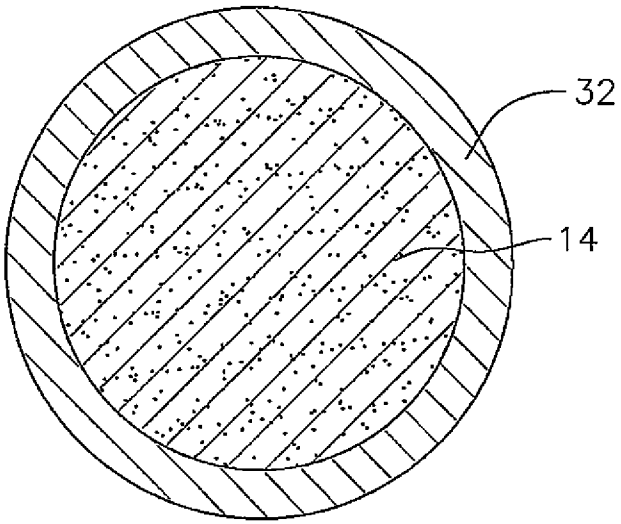
FIGS. 6 and 7 are cross-sectional views of exemplary embodiment composite cores used in exemplary embodiment composite core conductor cables of the present invention.

In a further exemplary embodiment, the core is pultruded with a heat dissipating veil 32 on its outer surface, as for example shown in FIG. 7. In one exemplary embodiment, the veil is an aluminum veil that is placed on the outer surface of the core during the pultrusion process. In an exemplary embodiment, the veil is also pultruded and may be formed simultaneously with the core during the core pultrusion process. In an exemplary embodiment, aluminum is chosen to form the veil if the conductor is also aluminum so as to not have any dissimilar metal corrosion occurring in the conductor. For example, if copper is used in the conductor, then the veil should also be copper. In one exemplary embodiment, the veil or cladding may be a net or an isotropic surface formed from aluminum. The veil or cladding acts to dissipate the heat from the core, when the core is heated due to the external environment or during the transmission of electricity through the conductor.

In another exemplary embodiment, the veil may be in the form of a braid formed on the outer surface of the core. In another exemplary embodiment, the fail safe netting may be formed from a metallic or thermally conductive material. In such case, the heat dissipating veil may be optional. It is well known in the art that composite core fibers are slow to heat up and are slow to cool down. By incorporating a metallic veil or cladding, or the conductive material filled resin core outer surface, the cooling of the composite core is enhanced.

In yet another exemplary embodiment, conduits carrying a cooling medium may be positioned within at least one of the grooves 24 along with a reinforcing fiber as described in relation to the embodiments shown in FIGS. 4 and 5 or in lieu of such reinforcing fibers. In another exemplary embodiment, the conduit may be placed in a groove running along the outer surface including or not including a reinforcing fiber. In one embodiment, the cooling medium may be a conductive material. The cooling medium may be a cryogenic fluid. In another exemplary embodiment, only conduits incorporating cryogenic fluid are placed within at least one of the grooves. The cooling medium may be in the form of a solid, a liquid or gas encased in a conduit. If in the form of a solid, the cooling medium may be placed in the groove without a conduit. In yet a further exemplary embodiment, the groove(s) 24 may be formed in a core at least the outer surface of which is formed from a conductive material (e.g., aluminum filler) filled resin as described herein.

The pultrusion processes referred to herein for forming the exemplary embodiment cores of this invention are well known in the art. Exemplary pultrusion processes are those used by Exel Composites of Helsinki Finland.

While the invention has been described with respect to a limited number of embodiments, those skilled in the art, having benefit of this disclosure, will appreciate that other embodiments can be devised which do not depart from the scope of the invention as disclosed herein. The invention is also defined in the following claims.

What is claimed is:

1. An electrical cable for the transmission of electricity between power poles or towers comprising:

a core formed from a fiber reinforced resin composite material reinforced by at least a first fiber;

a pultruded thermally conductive unified veil or unified cladding surrounding said core;

at least a second fiber over said veil or cladding; and a conductor surrounding said core, said veil or cladding, and said at least a second fiber.

2. The cable of claim 1, wherein said at least a second fiber is a fiber braid surrounding said core.

3. A method of forming an electrical cable for the transmission of electricity between power poles or towers comprising:

pultruding a core from a fiber reinforced resin composite material reinforced by at least a first fiber;

pultruding a thermally conductive unified veil or unified cladding over said core;

placing at least a second fiber over said veil or cladding; and surrounding said core, said veil or cladding, and said at least a second fiber with a conductor material.

4. The method of claim 3, wherein placing at least a second fiber over said veil or cladding comprises surrounding said veil or cladding with a fiber braid.

5. A method of forming an electrical cable for the transmission of electricity between power poles or towers comprising:

pultruding a core from fibers and a resin;

applying a thermally conductive particulate material comprising at least one of a powder and flakes to an outer surface of the core during the pultruding, wherein at least a portion of said conductive particulate material is mixed with the resin at the outer surface of the core; and surrounding said core with a conductor material, wherein the thermally conductive particulate material is of the same type as the conductor material.

6. The method of claim 5, wherein applying a thermally conductive particulate material comprises mixing the particulate material with the resin forming the outer surface of said core.

7. A method of forming an electrical cable for the transmission of electricity between power poles or towers comprising:

pultruding a core from fibers and a thermally conductive particulate material filled resin, said core having an outer surface including the thermally conductive particulate material, wherein said thermally conductive particulate material comprises at least one of a powder and flakes; and surrounding said core with a conductor material, said conductor material being adjacent to said outer surface of said core, wherein the thermally conductive particulate material is of the same type as the conductor material.

8. The method as recited in claim 7, wherein the thermally conductive particulate material comprises aluminum particulate material.

9. The method as recited in claim 8, wherein the thermally conductive particulate material filled resin is formed by mixing the thermally conductive particulate material with a resin in a ratio of 20%-50%.

10. A method of forming an electrical cable for the transmission of electricity between power poles or towers comprising:

pultruding a core having an inner portion formed from a fiber reinforced resin, and an outer portion surrounding at least a portion of the inner portion, said outer portion formed from a fiber reinforced resin including a thermally conductive particulate material comprising at least one of a powder and flakes, wherein both the inner and outer portions of the core are pultruded simultaneously or sequentially; and surrounding said core with a conductor material, wherein the thermally conductive particulate material is of the same type as the conductor material.

11. The method of claim 10, wherein forming the outer portion comprises forming an outer layer having a radial thickness of at least ½ mil.

12. The method as recited in claim 10, wherein the thermally conductive particulate material comprises aluminum.

13. The method as recited in claim 12, wherein the thermally conductive particulate material is mixed with the resin in a ratio of 20%-50% by weight.

14. The method as recited in claim 10, wherein a type of the resin forming the inner portion is different from a type of the resin forming the outer portion.

15. The method as recited in claim 10, further comprising adding at least one of carbon nanotubes and carbon black to at least the resin forming the outer portion.

16. The method as recited in claim 15, wherein said at least one of carbon nanotubes and carbon black is added at a ratio relative to the at least the resin forming the outer portion.

17. The method as recited in claim 16, wherein the ratio is not greater than 3% by weight.

18. The method as recited in claim 10, wherein the inner portion does not contain said thermally conductive particulate material.

19. An electrical cable for the transmission of electricity between power poles or towers comprising:

a core formed from a fiber reinforced resin material reinforced by at least a first fiber, wherein at least a portion of said resin material forming at least an outer surface of said core comprises a thermally conductive particulate material comprising at least one of a powder and flakes; and a conductor surrounding said core and said first fiber, wherein the thermally conductive particulate material is of the same type as the conductor material.

20. The cable as recited in claim 19, wherein an outer surface portion of said core having a material thickness of at least ½ mil is formed from said resin comprising the conductive particulate material, said outer surface portion being a layer surrounding a central portion.

21. The cable as recited in claim 19, wherein the thermally conductive particulate material comprises aluminum.

22. The cable as recited in claim 21, wherein the thermally conductive particulate material is mixed with the resin in a ratio of 20%-50% by weight.

23. The cable as recited in claim 19, wherein an outer surface portion is a layer formed from a first resin comprising said conductive particulate material and a central portion is formed from a second resin different from the first resin, wherein said outer surface portion surrounds said central portion.

24. The cable as recited in claim 19, further comprising at least one of carbon nanotubes and carbon black to the resin mixed with the resin.

25. The cable as recited in claim 19, wherein an inner portion of said core being surrounded by said outer surface does not contain said thermally conductive particulate material.

26. An electrical cable for the transmission of electricity between power poles or towers comprising:

a core formed from a fiber reinforced composite material reinforced by at least a first fiber, said core having a tensile strength, a first end opposite a second end spaced apart by a length from the first end;

a bore pre-formed within the core and extending along the length of the core;

a second fiber within said pre-formed bore and moveable relative to said bore and having a length greater than the length of said core and extending beyond the first and second ends of said bore; and a conductor surrounding said core and said second fiber.

27. The cable as recited in claim 26, wherein said second fiber is impregnated with a flexible resin system.

28. The cable as recited in claim 26, wherein a flexible core comprising said second fiber extends within said bore.

29. A method of forming an electrical cable for the transmission of electricity between power poles or towers comprising:

pultruding a core having an inner portion formed from a first material comprising a fiber reinforced resin, and at least an outer portion surrounding the inner portion formed from a second material comprising a fiber reinforced resin filled with at least one of carbon nanotubes and carbon black, wherein said first material is different from said second material; and surrounding said core with a conductor material.

30. The method as recited in claim 29, wherein said at least one of carbon nanotubes and carbon black is added at a ratio relative to the resin of said at least an outer surface portion of no greater than 3% by weight.

31. The method as recited in claim 29, wherein said at least one of carbon nanotubes and carbon black is added at a ratio relative to the resin of said at least an outer surface portion of no greater than 1% by weight.

32. The method as recited in claim 29, wherein the first and second materials comprise the same fiber reinforced resin.

33. An electrical cable for the transmission of electricity between power poles or towers comprising:

a core formed from a fiber reinforced composite material reinforced by at least a first fiber, said core having a tensile strength, and said core having a length;

an axially expandable netting along said core, said netting having a tensile strength sufficient for supporting the weight of the cable, said expandable netting being moveable relative to said core; and a conductor surrounding said core.

34. The cable as recited in claim 33, wherein the netting runs in a groove along the length of the core.

35. The cable as recited in claim 33, wherein the netting runs in a bore in said core.

36. The cable as recited in claim 33, wherein said netting does not support the weight of the cable when the cable is suspended between the towers or poles.

37. The cable as recited in claim 33, wherein when said cable is suspended between said towers or poles, said netting is not fully expanded.

38. The cable as recited in claim 37, wherein the netting is fixed at each tower or pole.

39. The cable as recited in claim 33, wherein the conductor surrounds said netting.

40. The cable as recited in claim 33, wherein said netting surrounds said core.

41. The cable as recited in claim 40, wherein said netting defines a cylinder, and wherein said core is within said cylinder, and wherein said netting is capable of clamping onto said core when said core breaks for supporting said broken core.

42. The cable as recited in claim 33, wherein said netting clamps on said core when said netting is expanded by an amount.

43. An electrical cable for the transmission of electricity between power poles or towers comprising:

a core formed from a fiber reinforced resin material reinforced by at least a first fiber, wherein only a portion of said resin material forming at least an outer surface of said core comprises a thermally conductive particulate material comprising at least one of a powder and flakes; and a conductor surrounding said core and said first fiber.

44. The cable as recited in claim 43, wherein the thermally conductive particulate material comprises aluminum.

* * * * *